US006367899B1

(12) United States Patent
Hwang et al.

(10) Patent No.: US 6,367,899 B1
(45) Date of Patent: Apr. 9, 2002

(54) FORWARD PULL TYPE BOLT LOCK STRUCTURE OF A SLIDE

(75) Inventors: Shih-Long Hwang; Ken-Ching Chen; Chun-Chiang Wang, all of Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 09/964,347

(22) Filed: Sep. 28, 2001

(51) Int. Cl.[7] ..... A47B 88/04
(52) U.S. Cl. ..... 312/334.47; 312/334.44
(58) Field of Search ..... 312/330.1, 333, 312/334.1, 334.7, 334.8, 334.11, 334.44, 334.46, 334.47; 384/18, 21, 22

(56) References Cited

U.S. PATENT DOCUMENTS 4,423,914 A * 1/1984 Ley ..... 312/334.47 X
4,549,773 A * 10/1985 Papp et al. ..... 312/334.47 X
5,484,209 A * 1/1996 Weng ..... 384/18
5,542,759 A * 8/1996 Krivec ..... 312/334.44

* cited by examiner

*Primary Examiner*—James O. Hansen
(74) *Attorney, Agent, or Firm*—Bacon & Thomas, PLLC

(57) ABSTRACT

A forward pull type bolt lock structure of a slide includes an outer rail provided with first and second locking blocks. An inner rail is received in the outer rail and is provided with a mounting hole for a pivot member to pivot one end of a positioning member whose other end is provided with a guide block. The positioning member has one side having a press bar supported on one lip of the inner rail, and the other side provided with a cutout and a stop portion. A slide plate is received between the inner rail and the outer rail, and provided with a drawing block for drawing the slide plate to move in the inner rail. The slide plate is provided with a guide slot having an oblique guide face. The guide block of the positioning member is supported on the oblique guide face.

4 Claims, 4 Drawing Sheets

FORWARD PULL TYPE BOLT LOCK STRUCTURE OF A SLIDE

BACKGROUND OF THE INVENTION

1. Field of the Invention

The present invention relates to a forward pull type bolt lock structure of a slide, and more particularly to a slide at least containing an inner rail and an outer rail having forward pull type bolt lock structure for separating the inner rail from the outer rail.

2. Description of the Related Art

A slide is usually used to connect and guide two articles that may be moved relative to each other, such as a cupboard and its drawer or a computer table and its keyboard support rack.

A conventional two-stage type slide generally comprises an outer rail and an inner rail. For example, the outer rail may be fixed in a cupboard to support the inner rail, and the inner rail is fixed at two sides of the drawer of the cupboard. The inner rail and the outer rail may be coupled with each other by such as the design of a ball bearing, and the inner rail may be moved in the axial direction of the outer rail reciprocally. Thus, the drawer may be pulled outward from or retracted into the cupboard freely by the slide.

The conventional two-stage type slide containing the inner rail and the outer rail needs to have the design of a bolt lock, so that when the inner rail is moved with the drawer to be pulled outward from the cupboard and moved toward the distal end of the intermediate rail to a usage position, the inner rail may be stopped at the distal end of the outer rail, thereby maintaining the drawer at the usage position temporarily. The bolt lock has to possess the function of detaching the drawer, so that the drawer and the inner rail may be detached from and retracted into the cupboard.

A conventional three-stage type drawer slide structure in accordance with the prior art shown in FIG. 6 primarily comprises an outer rail 91, an intermediate rail 92, and an inner rail 93. Multiple rolling balls 94 are mounted between the intermediate rail 92 and the inner rail 93, so that the inner rail 93 may slide along the intermediate rail 92. At the same time, for facilitating the mounting work of the conventional three-stage type drawer slide structure, the inner rail 93 is provided with a locking member 95 which has legs 96 that may be opened and closed elastically. The intermediate rail 92 is provided with a catch 97 protruded with a stop 971. After the inner rail 93 is fitted in the intermediate rail 92 and when the inner rail 93 is pulled outward, the lug 951 of the locking member 95 is locked with the stop 971 of the catch 97, thereby preventing the inner rail 93 from detaching from the intermediate rail 92. Thus, the lug 951 of the locking member 95 and the stop 971 of the catch 97 may form a positioning structure to prevent outward detachment.

When the conventional three-stage type drawer slide structure is assembled and dismantled, the user needs to press the locking member 95 with his one finger. However, the space between the outer rail 91, the intermediate rail 92, and the inner rail 93 is very small, so that the user finger is easily clipped and injured.

SUMMARY OF THE INVENTION

The primary objective of the present invention is to provide a forward pull type bolt lock structure of a slide, wherein the slide may be assembled conveniently, and may be removed easily.

In accordance with the present invention, there is provided a forward pull type bolt lock structure of a slide, comprising:

an outer rail, having lips and provided with a first locking block and a second locking block;

an inner rail, received in the lips of the outer rail, the inner rail having lips protruded toward the outer rail, the inner rail provided with a mounting hole for a pivot member to pivot one end of a positioning member, the other end of the positioning member provided with a guide block, one side of the positioning member having a press bar which is rested on one lip of the inner rail, the other side of the positioning member having a wall which is provided with a cutout and a stop portion;

a slide plate received between the lips of the inner rail and the outer rail, the slide plate provided with a drawing block for drawing the slide plate to move in the inner rail, the slide plate combined with one end of a restoring member, the other end of the restoring member is combined with the inner rail, the slide plate provided with a guide slot, the guide slot having an oblique guide face, the guide block of the positioning member rested on the oblique guide face;

when the inner rail is extended with a larger length relative to the outer rail, the stop portion of the positioning member of the inner rail is rested on the first locking block of the outer rail, and the cutout of the wall of the positioning member is locked on the second locking block of the outer rail;

when the inner rail is retracted into the outer rail, the positioning member may press the press bar to pivot, so that the stop portion of the positioning member of the inner rail is separated from the first locking block of the outer rail, and the cutout of the wall of the positioning member is separated from the second locking block of the outer rail; and the slide plate may be moved with the inner rail, and the oblique guide face of the guide slot presses the positioning member to pivot, so that the stop portion of the positioning member of the inner rail is separated from the first locking block of the outer rail, and the cutout of the wall of the positioning member is separated from the second locking block of the outer rail.

Further benefits and advantages of the present invention will become apparent after a careful reading of the detailed description with appropriate reference to the accompanying drawings.

DETAILED DESCRIPTION OF THE PREFERRED EMBODIMENTS

Figure 1:
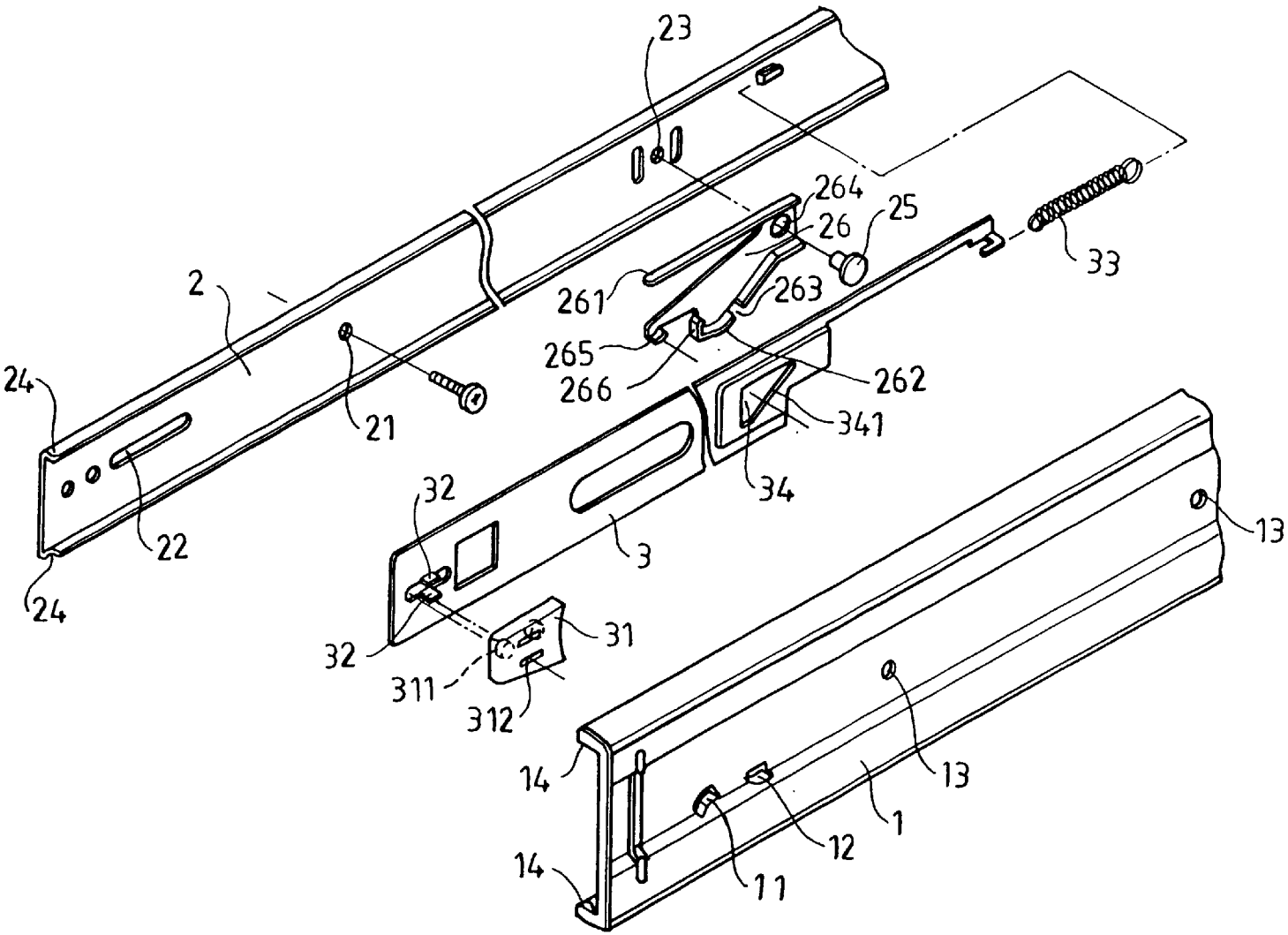
FIG. 1 is an exploded perspective view of a forward pull type bolt lock structure of a slide in accordance with the preferred embodiment of the present invention.

Referring to the drawings and initially to FIG. 1, a forward pull type bolt lock structure of a slide in accordance with a preferred embodiment of the present invention comprises an outer rail 1, an inner rail 2, and a slide plate 3.

The outer rail 1 may be fixed on a proper position such as the drawer, the side wall or the like, by positioning members through the positioning holes 13. The outer rail 1 has lips 14 each protruded toward one side, for receiving the inner rail 2 to guide movement of the inner rail 2. The outer rail has a first locking block 11 and a second locking block 12.

The inner rail 2 is received and moved between the two lips 14 of the outer rail 1, and may also be fixed on a proper position such as the drawer, the side wall or the like, by positioning members through the positioning holes 21. The inner rail 2 also has two lips 24 protruded toward the outer rail 1, so that the slide plate 3 may be received and moved between the two lips 24 of the inner rail 2. The inner rail 2 is additionally provided with a guide slot 22 and a mounting hole 23. A drawing block 31 is combined on the slide plate 3, and is provided with guide posts 311 that may be extended into the guide slot 22 of the inner rail 2, thereby limiting the slide plate 3 to move in a determined range. A positioning member 26 is pivotally mounted on the mounting hole 23 of the inner rail 2 by a pivot member 25. One side of the positioning member 26 has a press bar 261 which is supported on the lip 24 of the inner rail 2, so that the positioning member 26 has an elasticity that may be compressed and restored. The other side of the positioning member 26 has a wall 262 which is provided with a cutout 263 and a stop portion 266. One end of the positioning member 26 has a hole 264 in which the pivot member 25 is pivoted, and the other end of the positioning member 26 is provided with a protruding guide block 265.

The slide plate 3 is mounted between the inner rail 2 and the outer rail 1. One end of the slide plate 3 is provided with a drawing block 31 which, as shown in the figure, has combination holes 312 combined with the lugs 32 of the slide plate 3. The drawing block 31 is additionally provided with guide posts 311 that may be extended into the guide slot 22 of the inner rail 2, thereby limiting the slide plate 3 to move in a determined range. The other end of the inner rail 2 is provided with a restoring member 33 which may be an elastic member as shown in the figure, and has a first end hooked on the slide plate 3 and a second end hooked on the inner rail 2. The slide plate 3 is provided with a guide slot 34 located adjacent to the restoring member 33. The guide slot 34 has an oblique guide face 341, and the guide block 265 of the positioning member 26 may be extended into the guide slot 34, and is supported on the oblique guide face 341. Thus, when the slide plate 3 is pulled, the positioning member 26 may be guided to pivot.

Figure 2:
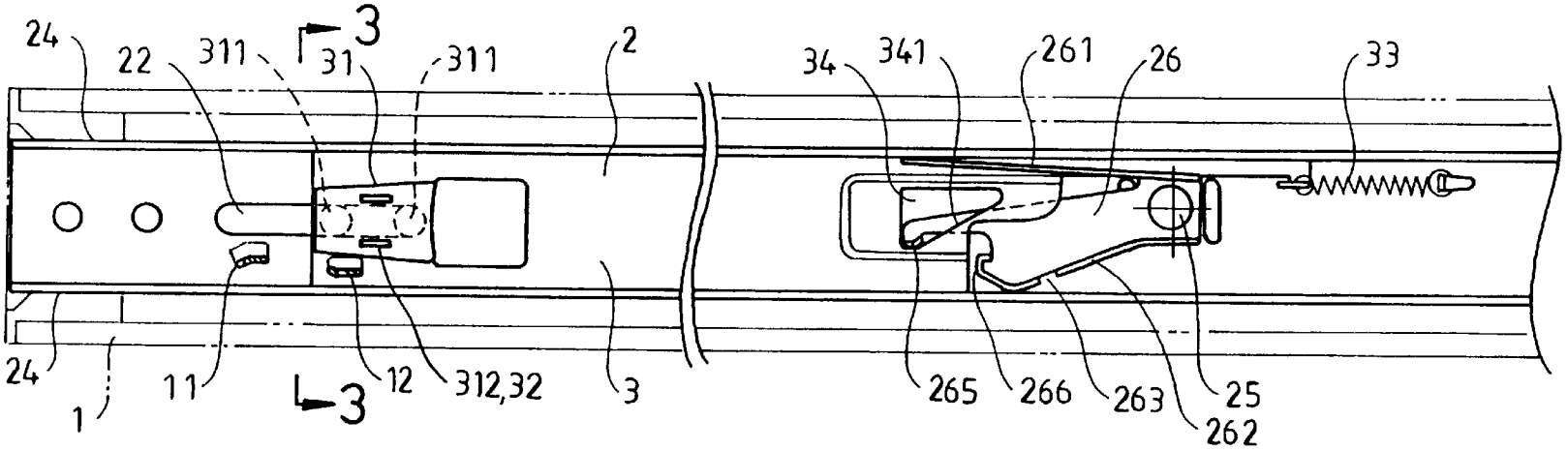
FIG. 2 is a plan assembly view of the forward pull type bolt lock structure of a slide as shown in FIG. 1.
Figure 3:
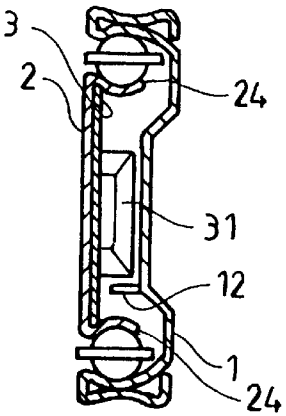
FIG. 3 is a cross-sectional view of the forward pull type bolt lock structure of a slide taken along line 3—3 as shown in FIG. 2.

Referring to FIGS. 2 and 3, the forward pull type bolt lock structure of a slide in accordance with the present invention is assembled. The slide plate 3 is received in the two lips 24 of the inner rail 2, and the inner rail 2 is received in the two lips 14 of the outer rail 1. At this time, the inner rail I and the outer rail 2 are not pulled with a smaller length. The slide plate 3 is pulled by the restoring member 33, so that the guide posts 311 of the drawing block 31 are locked in the right side (see FIG. 2) of the guide slot 22 of the inner rail 2, while the guide block 265 of the positioning member 26 is supported on the lower position of the oblique guide face 341 of the guide slot 34.

Figure 4:
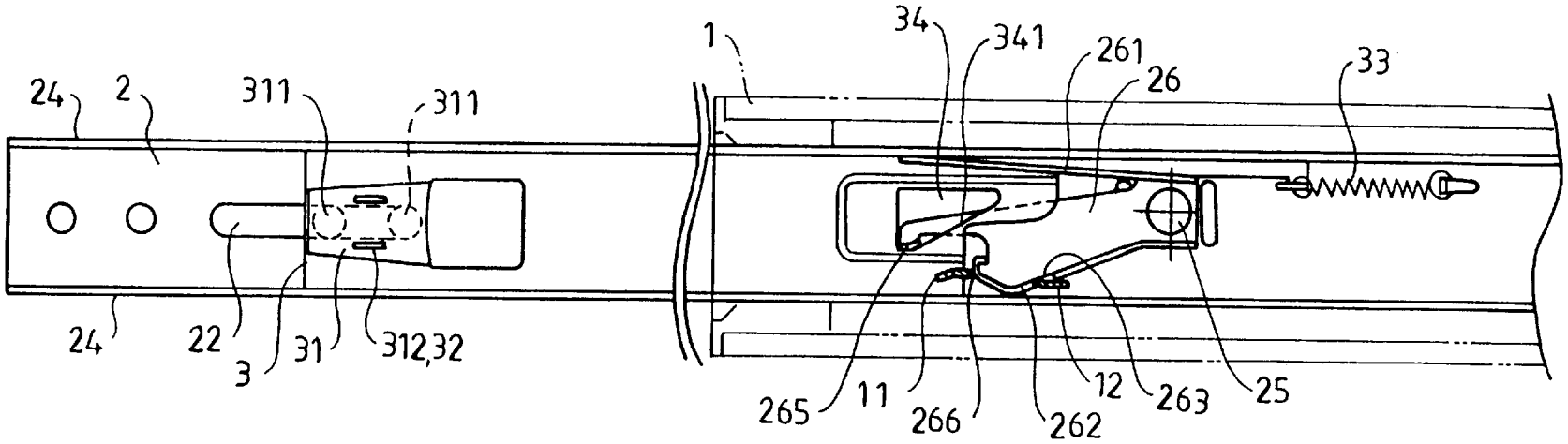
FIG. 4 is a plan assembly view of the forward pull type bolt lock structure of a slide as shown in FIG. 1.

Referring to FIG. 4, the slide is pulled to have a greater length. The inner rail 2 is pulled relative to the outer rail 1 (the slide plate 3 is pulled with the inner rail 2), until the stop portion 266 of the positioning member 26 is supported on the first locking block 11 of the outer rail 1, and the cutout 263 of the wall 262 of the positioning member 26 is locked on the second locking block 12 of the outer rail 1, so that the inner rail 2 is stopped, and cannot be moved relative to the outer rail 1. The cutout 263 of the wall 262 of the positioning member 26 is locked on the second locking block 12 of the outer rail 1, thereby providing a positioning effect when the slide is pulled to have the greatest length. When the slide needs to be retracted, the inner rail 2 may press the outer rail 1. At this time, the guide posts 311 of the drawing block 31 are still locked in the right side of the guide slot 22 of the inner rail 2, but the slide plate 3 is pulled by the restoring member 33. Thus, the slide plate 3 may also be retracted synchronously (relative to the outer rail 1). When the inner rail 2 is retracted, the cutout 263 of the wall 262 of the positioning member 26 and the second locking block 12 of the outer rail 1 produce a detaching force, and the press bar 261 of the positioning member 26 has a compressed elasticity. Thus, the positioning member 26 may be pivoted, so that the cutout 263 of the wall 262 of the positioning member 26 is detached from the second locking block 12 of the outer rail 1. Thus, the inner rail 2 and the slide plate 3 may be moved relative to the outer rail 1, thereby forming a smaller length as shown in FIG. 2.

Figure 5:
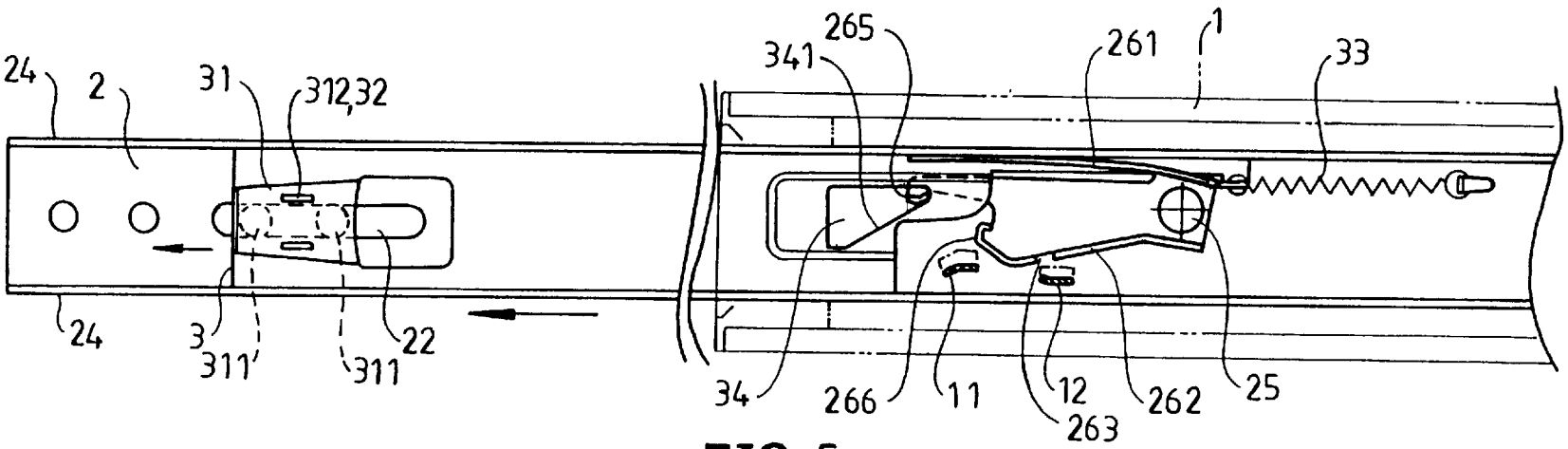
FIG. 5 is a schematic operational view of the forward pull type bolt lock structure of a slide as shown in FIG. 4.
Figure 6:
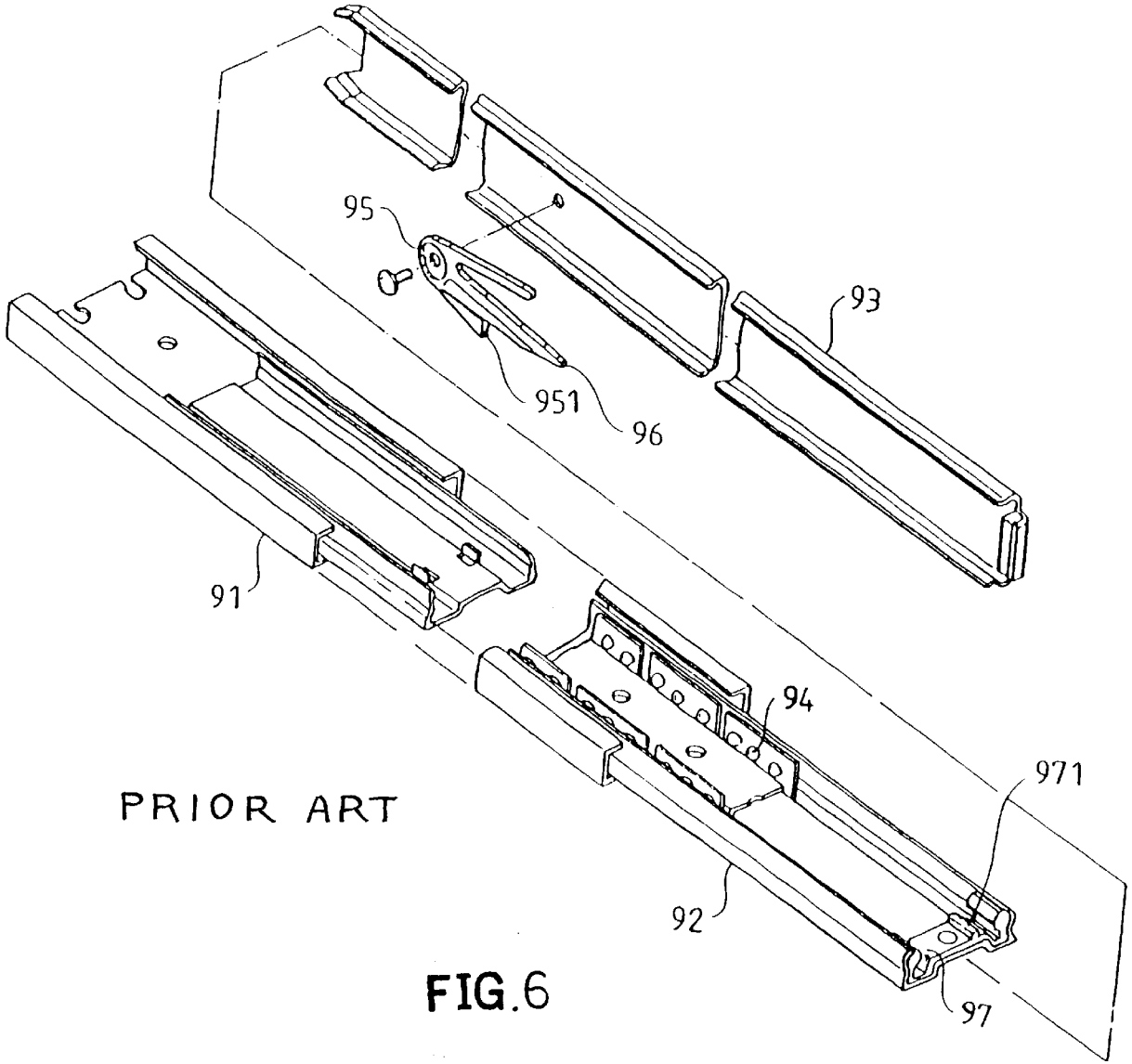
PRIOR ART FIG.6
FIG. 6 is an exploded perspective view of a conventional three-stage type drawer slide structure in accordance with the prior art.

Referring to FIG. 5, the inner rail 2 is to be separated from the outer rail 1. The slide plate 3 is moved leftward relative to the inner rail 2, so that the guide posts 311 of the drawing block 31 of the slide plate 3 are moved to the left side of the guide slot 22 of the inner rail 2. At this time, the oblique guide face 341 of the guide slot 34 of the slide plate 3 may guide the guide block 265 of the positioning member 26 to lift. Thus, the positioning member 26 may be pivoted about the pivot member 25, such that the stop portion 266 of the positioning member 26 is separated from the first locking block 11 of the outer rail 1, and the cutout 263 of the wall 262 of the positioning member 26 is separated from the second locking block 12 of the outer rail 1, and such that the inner rail 2 may be detached from the outer rail 1. In addition, when the inner rail 2 is detached from the outer rail 1, the guide posts 311 of the drawing block 31 of the slide plate 3 may be moved to the left side of the guide slot 22 of the inner rail 2, so that the inner rail 2 and the slide plate 3 may be locked in the outer rail 1 easily, thereby facilitating assembly of the slide structure.

Accordingly, in accordance with the forward pull type bolt lock structure of a slide of the present invention, the inner rail may be mounted in and detached from the outer rail conveniently. In addition, when the inner rail is pulled relative to the outer rail to have a larger length, the stop portion of the positioning member is supported on the first locking block of the outer rail, and the cutout of the wall of the positioning member is locked on the second locking block of the outer rail, thereby achieving a positioning effect of a bolt lock, so that the drawer of the slide will not have the problem of detachment.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A forward pull type bolt lock structure of a slide, comprising:

an outer rail, having lips and provided with a first locking block and a second locking block;

an inner rail, received in the lips of the outer rail, the inner rail having lips protruded toward the outer rail, the inner rail provided with a mounting hole for a pivot member to pivot one end of a positioning member, the other end of the positioning member provided with a guide block, one side of the positioning member having a press bar which is rested on one lip of the inner rail, the other side of the positioning member having a wall which is provided with a cutout and a stop portion;

a slide plate received between the lips of the inner rail and the outer rail, the slide plate provided with a drawing block for drawing the slide plate to move in the inner rail, the slide plate combined with one end of a restoring member, the other end of the restoring member is combined with the inner rail, the slide plate provided with a guide slot, the guide slot having an oblique guide face, the guide block of the positioning member is supported on the oblique guide face;

when the inner rail is extended relative to the outer rail, the stop portion of the positioning member of the inner rail is supported on the first locking block of the outer rail, and the cutout of the wall of the positioning member is locked on the second locking block of the outer rail;

when the inner rail is retracted into the outer rail, the positioning member may press the press bar to pivot, so that the stop portion of the positioning member of the inner rail is separated from the first locking block of the outer rail, and the cutout of the wall of the positioning member is separated from the second locking block of the outer rail; and the slide plate may be moved with the inner rail, and the oblique guide face of the guide slot presses the positioning member to pivot, so that the stop portion of the positioning member of the inner rail is separated from the first locking block of the outer rail, and the cutout of the wall of the positioning member is separated from the second locking block of the outer rail.

2. The forward pull type bolt lock structure of a slide as claimed in claim 1, wherein the drawing block has combination holes combined with lugs of the slide plate.

3. The forward pull type bolt lock structure of a slide as claimed in claim 1, wherein the restoring member is an elastic member.

4. The forward pull type bolt lock structure of a slide as claimed in claim 1, wherein the inner rail is provided with a guide slot, and the drawing block is provided with guide posts that may be extended into the guide slot of the inner rail, thereby limiting the slide plate to move in a determined range.

* * * * *